US007065874B2

(12) United States Patent
Yamaguchi et al.

(10) Patent No.: US 7,065,874 B2
(45) Date of Patent: Jun. 27, 2006

(54) METHOD FOR MAKING LIQUID EJECTION HEAD

(75) Inventors: Nobuhito Yamaguchi, Tokyo (JP); Akihiro Mouri, Tokyo (JP); Hidehito Takayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 10/882,250

(22) Filed: Jul. 2, 2004

(65) Prior Publication Data

US 2005/0012787 A1 Jan. 20, 2005

(30) Foreign Application Priority Data

Jul. 18, 2003 (JP) ..... 2003-198865

(51) Int. Cl.
*B21D 53/76* (2006.01)
*B41J 2/045* (2006.01)

(52) U.S. Cl. ..... 29/890.1; 29/25.35; 29/830; 29/831; 29/832; 347/68

(58) Field of Classification Search ..... 29/890.1, 29/25.35, 830, 831, 832; 347/68, 70, 47, 347/97, 72; 427/100
See application file for complete search history.

(56) References Cited

U.S. PATENT DOCUMENTS 4,367,478 A * 1/1983 Larsson ..... 347/68
4,418,355 A 11/1983 DeYoung et al.
5,478,606 A * 12/1995 Ohkuma et al. ..... 427/555
5,980,026 A * 11/1999 Imamura et al. ..... 347/65
6,241,350 B1 * 6/2001 Otsuka et al. ..... 347/94
2004/0017440 A1 1/2004 Takayama et al.
2004/0021745 A1 2/2004 Mouri et al.

FOREIGN PATENT DOCUMENTS

JP 63-25942 5/1988

* cited by examiner

*Primary Examiner*—A. Dexter Tugbang
*Assistant Examiner*—Tai Van Nguyen
(74) *Attorney, Agent, or Firm*—Fitzpatrick, Cella, Harper & Scinto

(57) ABSTRACT

A method for making a liquid ejection head includes the steps of placing a vibrator unit including a plurality of piezoelectric elements arranged in a comb shape in a head housing; filling each of the spaces between the piezoelectric elements and in the receiving sections of the head housing, and the liquid feed openings with a resin; depositing a resin on a planar surface including the ends of the piezoelectric elements, followed by patterning the resin to form islands which are isolated pressure-transmitting portions; placing a diaphragm on the patterned resin and forming a soluble resin pattern on the diaphragm; forming a coating layer on the soluble resin pattern; and dissolving away the soluble resin pattern to form a liquid feed chamber, pressure chambers, etc.

11 Claims, 12 Drawing Sheets

METHOD FOR MAKING LIQUID EJECTION HEAD

BACKGROUND OF THE INVENTION

1. Field of the Invention

The present invention relates to methods for making liquid ejection heads which are used for head cartridges for generating liquid droplets by an ink jet (liquid ejection) system or the like, liquid ejection apparatuses, etc.

The present invention also relates to methods for making liquid ejection heads which can be used for apparatuses, such as printers, copying machines, facsimile machines provided with communication systems, and word processors provided with printers, in which recording is performed on recording media, such as paper, yarn, fibers, textiles, leather, metal, plastic, glass, and ceramic, and also for recording apparatuses compositely combined with various processors for industrial use. In this specification, the term "recording" means not only providing an image having meaning, such as characters or graphics, on a recording medium, but also providing an image having no meaning, such as patterns, on a recording medium.

2. Description of the Related Art

Generally, in an on-demand type liquid ejection recording head, pressure chambers are formed by placing a nozzle plate having a plurality of nozzles so as to face a diaphragm which can be partially elastically deformed by piezoelectric elements (piezoelectric vibrators). A liquid, such as ink, is introduced by suction into the pressure chambers due to contraction and elongation of the piezoelectric elements, and then liquid droplets are ejected from the nozzles due to elongation of the piezoelectric elements. In order to improve the connection between the piezoelectric elements and the diaphragm, for example, as disclosed in U.S. Pat. No. 4,418,355, a coupling member is interposed between each piezoelectric element and the diaphragm so that the displacement of the piezoelectric element is efficiently transmitted to the pressure chamber. Japanese Patent Publication No. 63-25942 also discloses an ejection apparatus using a foot to improve the connection. In either case, the piezoelectric elements and the members constituting the pressure chambers are separately formed and then joined to each other. In the joining process, high alignment accuracy is required, resulting in an increase in manufacturing cost. It is also likely that the displacement of the piezoelectric elements is not efficiently transmitted to the pressure chambers or the displacement of the piezoelectric elements is transmitted to portions which should not have been displaced, resulting in instability of the meniscuses in the nozzles, i.e., cross-talk.

SUMMARY OF THE INVENTION

It is an object of the present invention to provide a method for making a liquid ejection head in which isolated pressure-transmitting portions (islands) are provided for transmitting pressures accurately to pressure chambers even if the piezoelectric elements are not produced with ultrahigh accuracy, and the isolated pressure-transmitting portions are integrally formed with the liquid passage structure including the pressure chambers, etc. Consequently, a joining step is eliminated such that joining errors are eliminated.

It is another object of the present invention to provide a simple and inexpensive method for making a high-performance liquid ejection head in which the pressure-transmitting operation is performed efficiently and cross-talk, etc., is prevented from occurring as much as possible.

In one aspect of the present invention, a method for making a liquid ejection head, the liquid ejection head including a plurality of ejection ports, a liquid passage having a plurality of pressure chambers communicating with the plurality of ejection ports, and a plurality of piezoelectric elements corresponding to the plurality of pressure chambers with isolated pressure-transmitting portions therebetween, includes the steps of forming a pattern for the liquid passage, forming a coating layer on the pattern for the liquid passage, forming a pressure-transmitting layer for forming the isolated pressure-transmitting portions on the coating layer, providing the plurality of piezoelectric elements on the pressure-transmitting layer so as to correspond to the plurality of pressure chambers, removing the pattern for the liquid passage to form the plurality of pressure chambers, and removing the pressure-transmitting layer other than the portions corresponding to the plurality of pressure chambers to form the isolated pressure-transmitting portions.

In another aspect of the present invention, a method for making a liquid ejection head, the liquid ejection head including a plurality of ejection ports, a liquid passage having a plurality of pressure chambers communicating with the plurality of ejection ports, and a plurality of piezoelectric elements corresponding to the plurality of pressure chambers with isolated pressure-transmitting portions therebetween, the plurality of piezoelectric elements being arranged in a comb shape, includes the steps of filling the spaces between the piezoelectric elements with a filler, forming a pressure-transmitting layer for forming the isolated pressure-transmitting portions on the plane including the ends of the plurality of piezoelectric elements, placing a diaphragm on the pressure-transmitting layer and forming a pattern for the liquid passage on the diaphragm, forming a coating layer on the pattern for the liquid passage, removing the pattern for the liquid passage to form the plurality of pressure chambers, and removing the pressure-transmitting layer other than the portions corresponding to the plurality of pressure chambers to form the isolated pressure-transmitting portions.

In another aspect of the present invention, a method for making a liquid ejection head, the liquid ejection head including a plurality of ejection ports, a liquid passage having a plurality of pressure chambers communicating with the plurality of ejection ports, and a plurality of piezoelectric elements placed in parallel so as to correspond to the plurality of pressure chambers with isolated pressure-transmitting portions therebetween, includes the steps of filling the spaces between the piezoelectric elements with a filler, forming a pressure-transmitting layer for forming the isolated pressure-transmitting portions on the plane including the ends of the plurality of piezoelectric elements, placing a diaphragm on the pressure-transmitting layer and forming a pattern for the liquid passage on the diaphragm, forming a coating layer on the pattern for the liquid passage, removing the pattern for the liquid passage to form the plurality of pressure chambers, and removing the pressure-transmitting layer other than the portions corresponding to the plurality of pressure chambers to form the isolated pressure-transmitting portions.

In accordance with the present invention, since the coating layer for forming the pressure chambers and the isolated pressure-transmitting portions composed of a resin are integrally formed by photolithography, it is possible to stably achieve a highly accurate alignment between the isolated pressure-transmitting portions joined to the piezoelectric elements and the pressure chambers.

Consequently, the vibration of an activated piezoelectric element does not affect adjacent pressure chambers. With respect to the pressure chamber belonging to the activated piezoelectric element, pressure can be uniformly transmitted in a wide range over the pressure chamber orthogonal to the array of ejection ports (array of nozzles).

As a result, it is possible to inexpensively manufacture an accurate liquid ejection head in which the displacement of the piezoelectric elements is efficiently transmitted, and meniscuses in the nozzles are stably maintained by preventing the displacement from being transmitted to adjacent pressure chambers.

As described above, in accordance with the present invention, since the liquid passage structure and the islands, which are the isolated pressure-transmitting portions joined to the piezoelectric elements, are integrally formed, high alignment accuracy is achieved, and it is possible to extremely easily set the positional accuracy between the piezoelectric elements and the islands individually corresponding to the pressure chambers. Moreover, since the distance between an island and a corresponding piezoelectric element can be decreased, it is possible to easily manufacture a liquid ejection head having a high operating frequency.

Consequently, the vibration of an activated piezoelectric element is not transmitted to adjacent pressure chambers. With respect to the pressure chamber belonging to the activated vibrator, pressure is uniformly transmitted in a wide range over the pressure chamber orthogonal to the array of nozzles so that the displacement of the piezoelectric element can be efficiently transmitted. Meniscuses in the nozzles are stably maintained by preventing the displacement from being transmitted to adjacent pressure chambers. Thereby, in particular, it is possible to inexpensively manufacture a liquid ejection head suitable for ultrahigh definition printing because of its stable ejection.

Further objects, features and advantages of the present invention will become apparent from the following description of the preferred embodiments with reference to the attached drawings.

DESCRIPTION OF THE PREFERRED EMBODIMENTS

The embodiments of the present invention will be described below with reference to the drawings.

Figure 1:
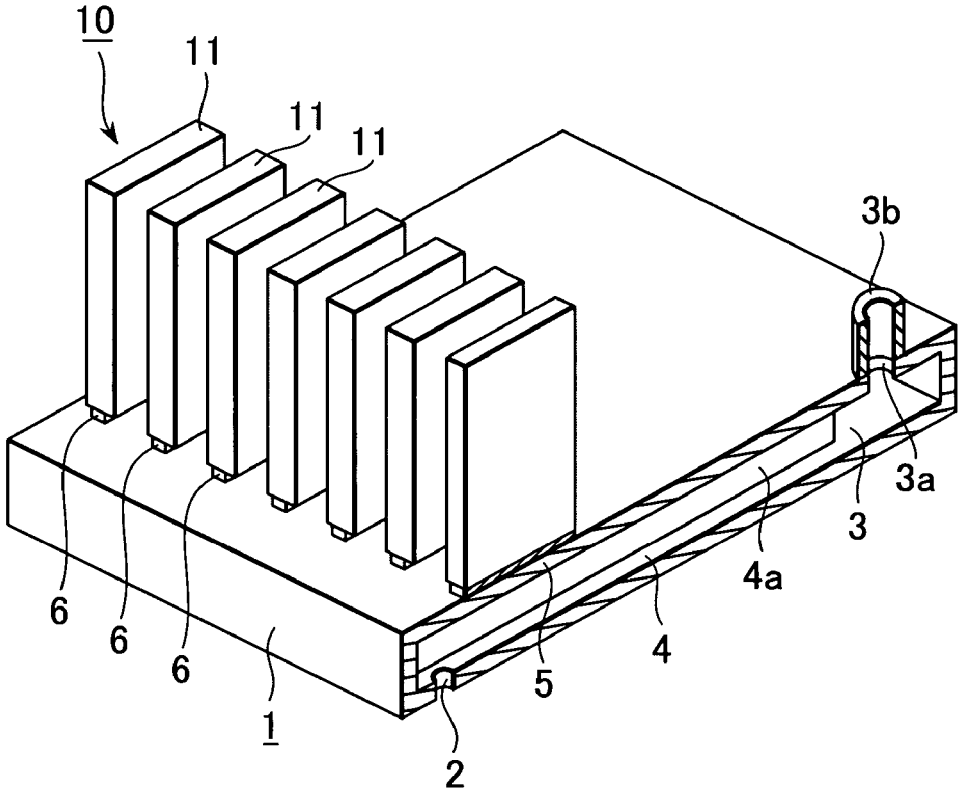
FIG. 1 is a partially cutaway perspective view of a liquid ejection head in a first embodiment of the present invention.

FIG. 1 schematically shows an overall structure of a liquid ejection head in a first embodiment of the present invention. A coating layer 1, which is a liquid passage structure, includes a nozzle array composed of a plurality of ejection ports (nozzles) 2; a liquid feed chamber 3 for feeding a liquid, which is formed by dissolving away a resin pattern as will be described below; pressure chambers 4 for receiving and compressing the liquid; a liquid feed opening 3*a* which communicates with the liquid feed chamber 3 and which is used for introducing the liquid from outside; a diaphragm 5 for applying pressure to the pressure chambers 4; and convex islands 6, which are isolated pressure-transmitting portions, extending in the longitudinal direction of the pressure chambers 4. With each island 6, the diaphragm 5 and a piezoelectric element 11 of a vibrator unit 10 are joined to each other. The pressure chambers 4 are isolated by division walls 4*a* and disposed in parallel, and the corresponding ejection ports 2 are also disposed in parallel.

A liquid feed member 3*b* is bonded to the liquid feed opening 3*a* with an adhesive. By connecting the liquid feed member 3*b* to a liquid tank (not shown in the drawing), the liquid can be fed. As described above, the coating layer 1 is a liquid passage structure including liquid passages, such as the liquid feed chamber 3 and the pressure chambers 4, and the diaphragm 5, and is integrally formed with the islands 6.

As the piezoelectric element 11, which is a liquid ejection energy-generating element, for example, a piezoelectric element having a laminated structure including a piezoelectric member composed of lead zirconate titanate (PZT) and electrodes may be employed. Each piezoelectric element 11 is fixed on a base plate (not shown in the drawing). A plurality of piezoelectric elements 11 are disposed in parallel so as to correspond to the pressure chambers 4. In order to drive the piezoelectric elements 11, a common electrode (not shown in the drawing) and individual electrodes (not shown in the drawing) are provided. The common electrode and the individual electrodes are connected to a common line and a signal line, respectively, to which driving signals are sent from a driving circuit (not shown in the drawing).

Figure 2A:
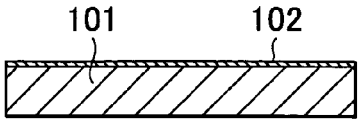
FIGS. 2A to 2L are sectional views showing steps in a method for making a liquid ejection head according to Example 1.
Figure 2B:
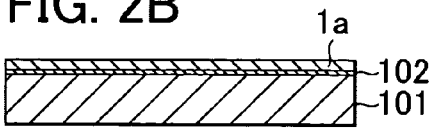
Figure 2C:
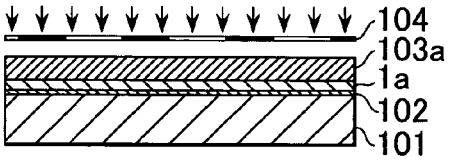
Figure 2D:
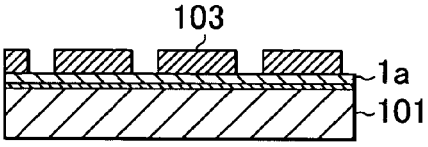

FIGS. 2A to 2L are sectional views showing steps in a method for making a liquid ejection head in this embodiment. As shown in FIG. 2A, a separating layer 102 is formed on a substrate 101 by applying a parting agent or the like. As shown in FIG. 2B, a first resin coating layer 1*a* is deposited on the separating layer 102. As shown in FIG. 2C, a soluble resin layer 103*a* is deposited thereon and is subjected to photolithography using a mask 104 to form a pattern 103 having the shapes of a liquid feed chamber 3 and pressure chambers 4 as shown in FIG. 2D.

Figure 2E:
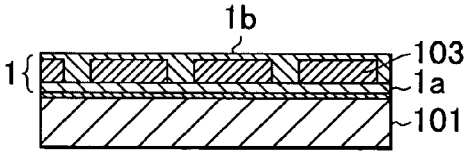

Next, as shown in FIG. 2E, the pattern 103 is covered with a second resin coating layer 1*b*, and a coating layer 1 composed of the first resin coating layer 1*a* and the second resin coating layer 1*b* is thereby formed.

Figure 2F:
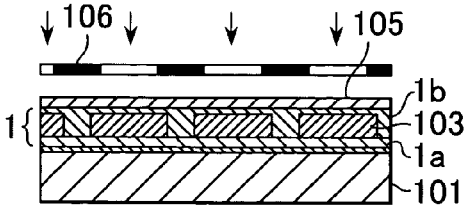
Figure 2G:
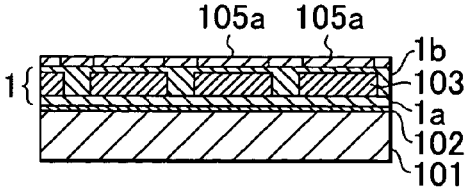
Figure 2H:
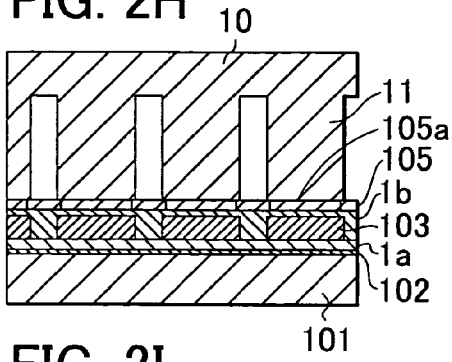

As shown in FIG. 2F, a photosensitive resin layer 105 is deposited on the coating layer 1, and exposure is performed using a mask 106. Thereby, latent images 105*a* of islands 6 corresponding to the individual pressure chambers 4 are integrally formed with the coating layer 1 as shown in FIG. 2G. Next, as shown in FIG. 2H, piezoelectric elements 11 of a vibrator unit 10 are placed so as to correspond to the respective islands 6. The pattern 103 for the pressure chambers 4, the latent images 105*a* of the islands 6, and the piezoelectric elements 11 are aligned to each other using alignment means, such as alignment marks, provided on the vibrator unit 10, which are observable through the transparent substrate 101 and the resin coating layers 1*a* and 1*b*. The piezoelectric elements 11 are then bonded to the islands 6.

Figure 2I:
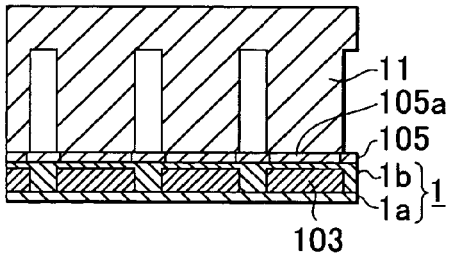
Figure 2J:
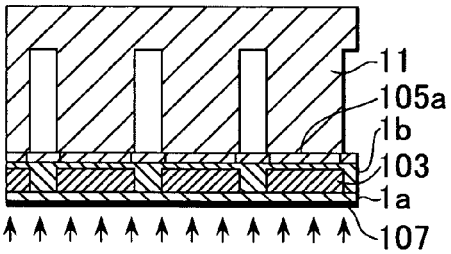
Figure 2K:
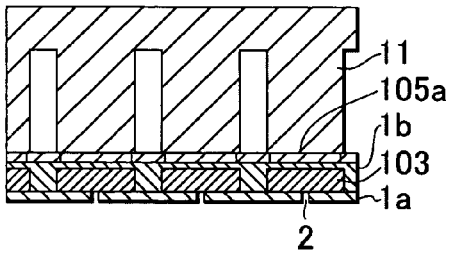

As shown in FIG. 2I, the substrate 101 is removed by dissolving away the separating layer 102. As shown in FIG. 2J, the first resin coating layer 1*a* is subjected to patterning by laser ablation, plasma etching, or the like, using a resist layer 107. Ejection ports 2 are thereby formed as shown in FIG. 2K. Alternatively, the ejection ports 2 may be formed immediately after the first resin coating layer 1*a* is deposited on the separating layer 102.

Figure 2L:
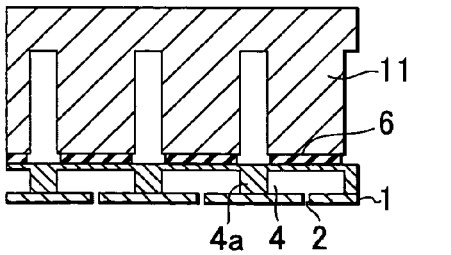

Next, as shown in FIG. 2L, the pattern 103 and the unexposed portions of the photosensitive resin layer 105 are removed by dissolving them away, and a liquid feed chamber 3 (see FIG. 1), the pressure chambers 4, and the islands 6 (each island 6 being isolated from adjacent piezoelectric elements 11) are thereby formed. In this step, it is desirable to simultaneously remove the pattern 103 and the unexposed portions of the photosensitive resin layer 105 for ease of fabrication.

EXAMPLE 1

A specific example of a method for making the liquid ejection head in the first embodiment shown in FIGS. 2A to 2L will be described below.

In the step shown in FIG. 2A, a heat-resistant glass substrate with a thickness of 5 mm was used as a substrate 101, and a separating layer 102 was formed on the substrate 101. In order to form the separating layer 102, a dry film with a thickness of 2 μm was prepared by applying soluble poly(methyl isopropenyl ketone) (ODUR-1010 manufactured by Tokyo Ohka Kogyo Co., Ltd.) onto a PET base, followed by drying, and the dry film was transferred to the substrate 101 by lamination. Additionally, the ODUR-1010 was concentrated before use because it was not otherwise possible to form a thick film due to its low viscosity. Subsequently, prebaking was performed at 120° C. for 20 minutes.

Next, as shown in FIG. 2B, in order to form a portion of a coating layer 1 for forming a liquid feed chamber 3, pressure chambers 4, etc., a first resin coating layer 1*a* with a thickness of 5 μm was formed on the separating layer 102 by spin coating, roll coating, or the like. In order to form the first resin coating layer 1*a*, a resin composition was prepared using the following components:

| | |
|---|---|
| Epoxy resin (o-cresol novolac epoxy resin) | 100 parts |
| Cationic photopolymerization initiator (4,4-di-tert-butylphenyl iodonium hexafluoroantimonate | 1 part |
| Silane coupling agent (A-187 manufactured by Nippon Unicar Co., Ltd.) | 10 parts |

The resin composition was dissolved in a mixture of methyl isobutyl ketone and xylene, each at a concentration of 50% by weight, and the resultant solution was applied onto the separating layer 102 by spin coating to form a photosensitive resin layer with a thickness of 5 μm. In order to harden the photosensitive resin layer, exposure was performed.

Next, as shown in FIG. 2C, in order to form a liquid feed chamber 3 and pressure chambers 4, a soluble resin layer 103*a* with a thickness of 10 μm was formed on the first resin coating layer 1*a*. In order to form the resin layer 103*a*, a dry film with a thickness of 10 μm was prepared by applying soluble poly(methyl isopropenyl ketone) (ODUR-1010 manufactured by Tokyo Ohka Kogyo Co., Ltd.) onto a PET base, followed by drying, and the dry film was transferred to the first resin coating layer 1*a* by lamination. Additionally, the ODUR-1010 was concentrated before use because it was not otherwise possible to form a thick film due to its low viscosity. Subsequently, prebaking was performed at 120° C. for 20 minutes.

The resin layer 103*a* was subjected to exposure to form a pattern for the liquid passages with a Canon mask aligner PLA 520 (cold mirror CM290) using a mask 104. The exposure operation was performed for 1.5 minutes, and development was performed using methyl isobutyl ketone/xylene (2/1), followed by rinsing with xylene. As shown in FIG. 2D, a pattern 103 composed of the soluble resin was formed. The pattern 103 was prepared to secure spaces for the liquid feed chamber 3 and the pressure chambers 4 in the coating layer 1.

As shown in FIG. 2E, in order to form a diaphragm 5 and a liquid passage structure, such as division walls 4*a* of the pressure chambers 4, a second resin coating layer 1*b* with a thickness of 5 μm was formed on the pattern 103 by spin coating, roll coating, or the like. In order to form the second resin coating layer 1*b*, a resin composition was prepared using the following components:

| | |
|---|---|
| Epoxy resin (o-cresol novolac epoxy resin) | 100 parts |
| Cationic photopolymerization initiator (4,4-di-tert-butylphenyl iodonium hexafluoroantimonate | 1 part |
| Silane coupling agent (A-187 manufactured by Nippon Unicar Co., Ltd.) | 10 parts |

The resin composition was dissolved in a mixture of methyl isobutyl ketone and xylene, each at a concentration of 50% by weight, and the resultant solution was applied onto the pattern 103 by spin coating to form a photosensitive resin layer with a thickness of 5 μm. In order to harden the photosensitive resin layer, exposure was performed. The coating layer 1 shown in FIG. 1 includes the first and second resin coating layers 1*a* and 1*b* thus formed.

Next, as shown in FIG. 2F, in order to form islands 6 for bonding piezoelectric elements 11 to the second resin coating layer 1*b*, a photosensitive resin layer 105 with a thickness of 5 μm was formed on the second resin coating layer 1*b* by spin coating, roll coating, or the like. In order to form the photosensitive resin layer 105, a resin composition was prepared using the following components:

| | |
|---|---|
| Epoxy resin (o-cresol novolac epoxy resin) | 100 parts |
| Cationic photopolymerization initiator (4,4-di-tert-butylphenyl iodonium hexafluoroantimonate | 1 part |
| Silane coupling agent (A-187 manufactured by Nippon Unicar Co., Ltd.) | 10 parts |

The resin composition was dissolved in a mixture of methyl isobutyl ketone and xylene, each at a concentration of 50% by weight, and the resultant solution was applied onto the second resin coating layer 1*b* by spin coating to form the photosensitive resin layer 105 with a thickness of 5 μm. In order to harden the photosensitive resin layer 105, exposure was performed using a mask 106, and latent images 105*a* of the isolated islands 6 were thereby formed as shown in FIG. 2G.

As shown in FIG. 2H, the piezoelectric elements 11 were bonded to the photosensitive resin layer 105 provided with the latent images 105*a* of the isolated islands 6 using an epoxy adhesive. Since the substrate 101 and the coating layer 1 were light-transmissive, it was possible to bond the piezoelectric elements 11 onto the photosensitive resin layer 105 while observing alignment marks (not shown in the drawing) provided on the piezoelectric elements 11 from the substrate 101 side with a stereoscopic microscope. In this example, a stereoscopic microscope SZH-10 (trade name; manufactured by Nikon corporation) was used. In this way, it was possible to accurately determine the positions of the piezoelectric elements 11 with respect to the islands 6, thereby improving positional accuracy. After the piezoelectric elements 11 were bonded to the islands 6 with the epoxy adhesive, prebaking was performed at 120° C. for 20 minutes.

Next, as shown in FIG. 2I, the workpiece was immersed in methyl isobutyl ketone while applying ultrasonic waves to dissolve away the separating layer 102 disposed between the substrate 101 and the first resin coating layer 1*a*. The substrate 101 was thereby removed.

Subsequently, as shown in FIGS. 2J and 2K, ejection ports 2 were formed. First, as shown in FIG. 2J, a silicon-containing positive resist FH-SP (trade name; manufactured by Fuji Hunt) 107 was applied onto the surface of the first resin coating layer 1*a*, and patterning was performed. The ejection ports 2 were formed on the first resin coating layer 1*a* by laser ablation in which irradiation was performed by an excimer laser using a mask. The laser ablation was stopped at a predetermined position (depth) in the soluble pattern 103.

Next, as shown in FIG. 2L, the workpiece was immersed in methyl isobutyl ketone while applying ultrasonic waves to dissolve away the soluble pattern 103. The liquid passages, such as the liquid feed chamber 3 and the pressure chambers 4, were thereby formed. The latent images 105*a* of the photosensitive resin layer 105 were also thereby developed so as to form the islands 6.

A head unit thus formed includes the coating layer 1 including the liquid feed chamber 3 and the pressure chambers 4, and a vibration unit 10 including the piezoelectric elements 11. A liquid feed member 3*b* (FIG. 1) was joined to the head unit, and signal lines and a common line for driving the piezoelectric elements 11 were electrically connected to the head unit. A liquid ejection head was thereby completed.

The liquid ejection head was mounted on a liquid jet recording apparatus, and printing was performed using an ink composed of pure water/diethylene glycol/isopropyl alcohol/lithium acetate/black dye Food Black 2 (79.4/15/3/0.1/2.5). As a result, it was possible to perform printing stably, and high-quality printed matter was obtained.

EXAMPLE 2

Another specific example of a method for making the liquid ejection head in the first embodiment will be described below with reference to FIGS. 3A to 3L.

The method in this example is the same as that in Example 1 except that ejection ports 22 are formed by oxygen plasma etching. The same numerals are used for the same elements as those in Example 1 except for the ejection ports 22.

Figure 3A:
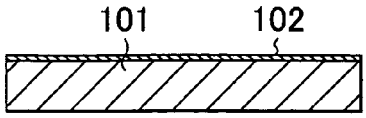
FIGS. 3A to 3L are sectional views showing steps in a method for making a liquid ejection head according to Example 2.
Figure 3B:
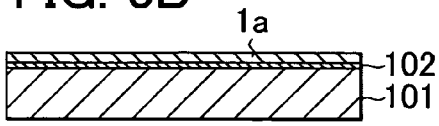
Figure 3C:
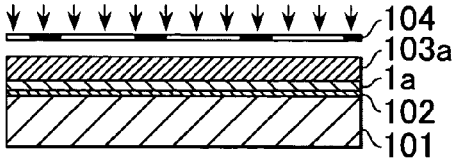
Figure 3D:
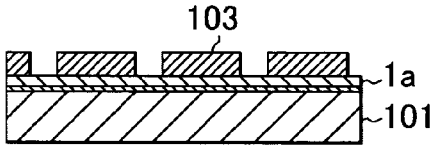
Figure 3E:
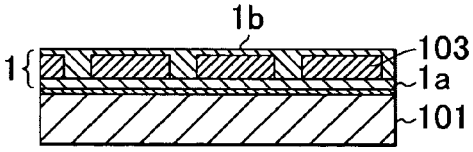
Figure 3F:
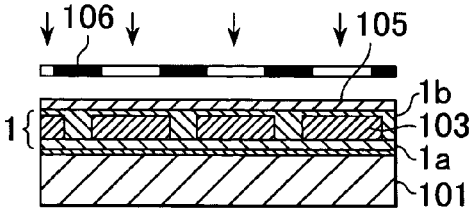
Figure 3G:
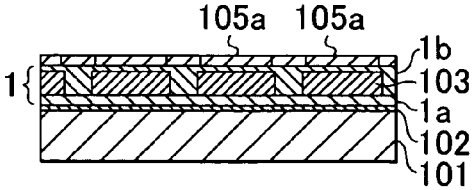
Figure 3H:
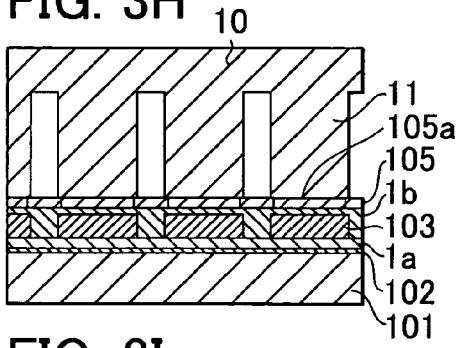
Figure 3I:
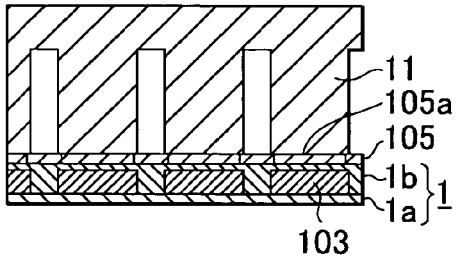
Figure 3J:
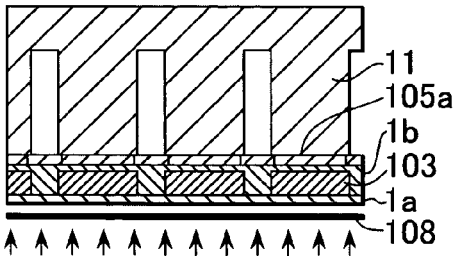
Figure 3K:
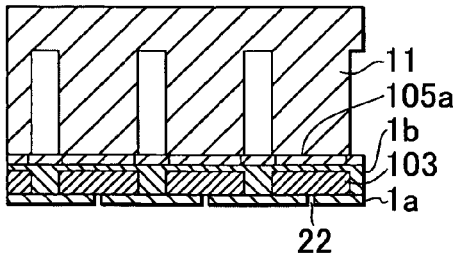
Figure 3L:
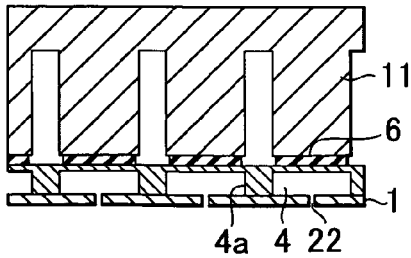

The steps shown in FIGS. 3A to 3I are the same as the steps shown in FIGS. 2A to 2I, and descriptions thereof will be omitted. As shown in FIG. 3J, in order to form the ejection ports 22, oxygen plasma etching was used. A resist layer 108 functioned as an oxygen-plasma resistant film. As shown in FIG. 3K, the first resin coating layer 1*a* was etched by oxygen plasma etching to form the ejection ports 22. The etching was stopped at a predetermined position in the soluble pattern 103. Next, as in Example 1, as shown in FIG. 3L, the soluble pattern 103 was dissolved away, and the liquid passages, such as the liquid feed chamber 3 and the pressure chambers 4, were thereby formed, and the latent images 105*a* of the photosensitive resin layer 105 were thereby developed so as to form the islands 6.

With respect to the liquid ejection head thus fabricated, as in the liquid ejection head in Example 1, it was possible to perform printing stably, and high-quality printed matter was obtained.

EXAMPLE 3

FIGS. 4A to 4J are sectional views showing steps in another specific example of a method for making the liquid ejection head in the first embodiment.

The method in this example is the same as that in Example 1 or 2 except for the step of forming ejection ports 32. The same numerals are used for the same elements as those in Example 1 or 2.

Figure 4A:
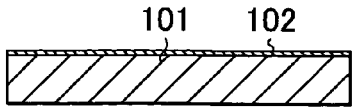
FIGS. 4A to 4J are sectional views showing steps in a method for making a liquid ejection head according to Example 3.

In the step shown in FIG. 4A, a heat-resistant glass substrate with a thickness of 5 mm was used as a substrate 101, and a separating layer 102 was formed on the substrate 101. In order to form the separating layer 102, a dry film with a thickness of 2 μm was prepared by applying soluble poly(methyl isopropenyl ketone) (ODUR-1010 manufactured by Tokyo Ohka Kogyo Co., Ltd.) onto a PET base, followed by drying, and the dry film was transferred to the substrate 101 by lamination. Additionally, the ODUR-1010 was concentrated before use because it was not otherwise possible to form a thick film due to its low viscosity. Subsequently, prebaking was performed at 120° C. for 20 minutes.

Figure 4B:
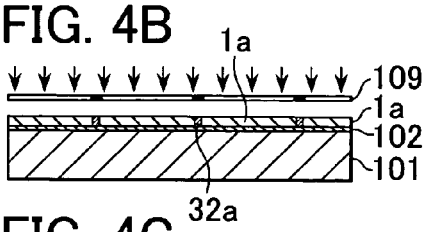

Next, as shown in FIG. 4B, in order to form a portion of a coating layer 1, i.e., a liquid passage structure (a liquid feed chamber 3 and pressure chambers 4), a first resin coating layer 1*a* with a thickness of 5 μm was formed on the separating layer 102 by spin coating, roll coating, or the like.

In order to form the first resin coating layer 1*a*, a resin composition was prepared using the following components:

| | |
|---|---|
| Epoxy resin (o-cresol novolac epoxy resin) | 100 parts |
| Cationic photopolymerization initiator (4,4-di-tert-butylphenyl iodonium hexafluoroantimonate | 1 part |
| Silane coupling agent (A-187 manufactured by Nippon Unicar Co., Ltd.) | 10 parts |

The resin composition was dissolved in a mixture of methyl isobutyl ketone and xylene, each at a concentration of 50% by weight, and the resultant solution was applied onto the separating layer 102 by spin coating to form a photosensitive layer with a thickness of 5 μm. In order to harden the photosensitive layer and secure the ejection ports 32 by forming latent images 32*a*, exposure was performed with a Canon mask aligner PLA 520 (cold mirror CM290) using a mask 109.

Figure 4C:
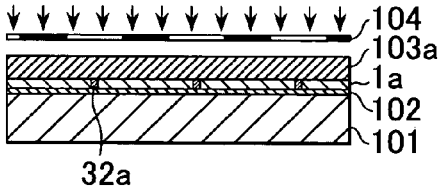

Next, as shown in FIG. 4C, in order to form the liquid feed chamber 3 and pressure chambers 4, a soluble resin layer 103*a* with a thickness of 10 μm was formed on the first resin coating layer 1*a*. In order to form the resin layer 103*a*, a dry film with a thickness of 10 μm was prepared by applying soluble poly(methyl isopropenyl ketone) (ODUR-1010 manufactured by Tokyo Ohka Kogyo Co., Ltd.) onto a PET base, followed by drying, and the dry film was transferred to the first resin coating layer 1*a* by lamination. Additionally, the ODUR-1010 was concentrated before use because it was not otherwise possible to form a thick film due to its low viscosity. Subsequently, prebaking was performed at 120° C. for 20 minutes.

Figure 4D:
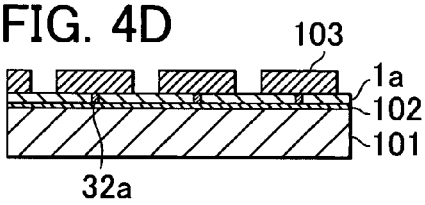

The resin layer 103*a* was subjected to exposure to form a pattern for the liquid passages with a Canon mask aligner PLA 520 (cold mirror CM290) using a mask 104. The exposure operation was performed for 1.5 minutes, and development was performed using methyl isobutyl ketone/xylene (2/1), followed by rinsing with xylene. Thereby, as shown in FIG. 4D, a pattern 103 composed of the soluble resin was formed. The pattern 103 was prepared to secure spaces for the liquid feed chamber 3 and the pressure chambers 4.

Figure 4E:
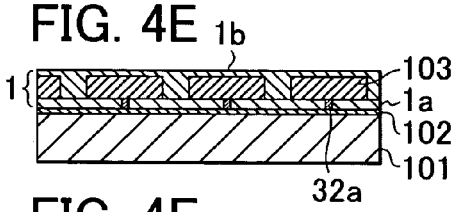

As shown in FIG. 4E, in order to form a diaphragm 5 and a portion of a structure for forming division walls 4*a* for the pressure chambers 4, a second resin coating layer 1*b* with a thickness of 5 μm was formed on the pattern 103 by spin coating, roll coating, or the like. In order to form the second resin coating layer 1*b*, a resin composition was prepared using the following components:

| | |
|---|---|
| Epoxy resin (o-cresol novolac epoxy resin) | 100 parts |
| Cationic photopolymerization initiator (4,4-di-tert-butylphenyl iodonium hexafluoroantimonate | 1 part |
| Silane coupling agent (A-187 manufactured by Nippon Unicar Co., Ltd.) | 10 parts |

The resin composition was dissolved in a mixture of methyl isobutyl ketone and xylene, each at a concentration of 50% by weight, and the resultant solution was applied onto the pattern 103 by spin coating to form a photosensitive resin layer with a thickness of 5 μm. In order to harden the photosensitive resin layer, exposure was performed.

Figure 4F:
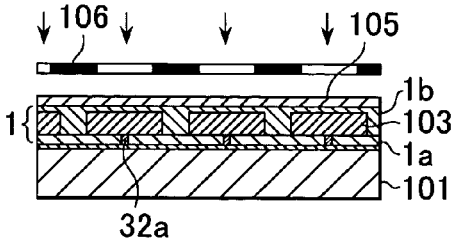
Figure 4G:
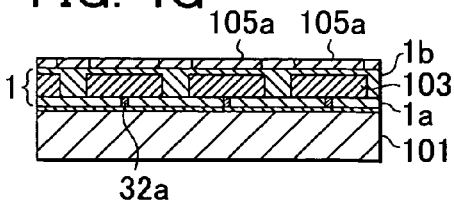

Next, as shown in FIG. 4F, in order to form islands 6 for bonding piezoelectric elements 11 to the second resin coating layer 1*b*, a photosensitive resin layer 105 with a thickness of 5 μm was formed on the second resin coating layer 1*b* by spin coating, roll coating, or the like. In order to form the photosensitive resin layer 105, a resin composition was prepared using the following components:

| | |
|---|---|
| Epoxy resin (o-cresol novolac epoxy resin) | 100 parts |
| Cationic photopolymerization initiator (4,4-di-tert-butylphenyl iodonium hexafluoroantimonate | 1 part |
| Silane coupling agent (A-187 manufactured by Nippon Unicar Co., Ltd.) | 10 parts |

The resin composition was dissolved in a mixture of methyl isobutyl ketone and xylene, each at a concentration of 50% by weight, and the resultant solution was applied onto the second resin coating layer 1*b* by spin coating to form the photosensitive resin layer 105 with a thickness of 5 μm. In order to harden the photosensitive resin layer 105, exposure was performed using a mask 106, and latent images 105*a* of the isolated islands 6 were thereby formed.

Figure 4H:
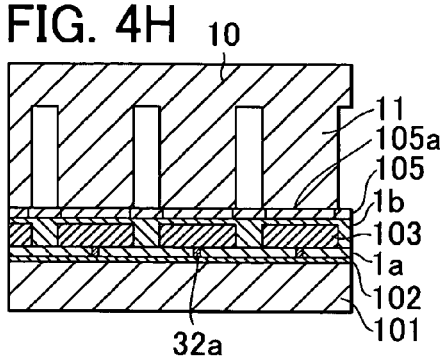

Next, as shown in FIG. 4H, the piezoelectric elements 11 were bonded to the photosensitive resin layer 105 provided with the latent images 105*a* of the isolated islands 6 using an epoxy adhesive. Since the substrate 101 and the coating layer 1 were light-transmissive, it was possible to bond the piezoelectric elements 11 onto the photosensitive resin layer 105 while observing alignment marks (not shown in the drawing) provided on the piezoelectric elements 11 from the substrate 101 side with a stereoscopic microscope. In this example, a stereoscopic microscope SZH-10 (trade name; manufactured by Nikon corporation) was used. In this way, it was possible to accurately determine the positions of the piezoelectric elements 11 with respect to the islands 6, thereby improving positional accuracy. After the piezoelectric elements 11 were bonded to the islands 6 with the epoxy adhesive, prebaking was performed at 120° C. for 20 minutes.

Figure 4I:
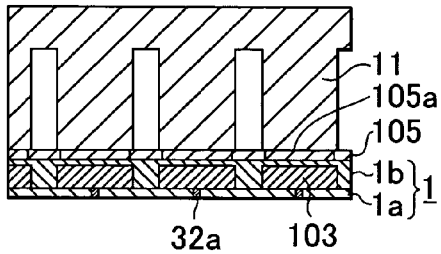

As shown in FIG. 4I, the workpiece was immersed in methyl isobutyl ketone while applying an ultrasonic wave to dissolve away the separating layer 102 disposed between the substrate 101 and the first resin coating layer 1*a*. The substrate 101 was thereby removed.

Figure 4J:
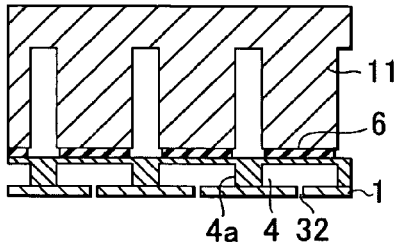

Next, as shown in FIG. 4J, the workpiece was immersed in methyl isobutyl ketone while applying an ultrasonic wave to dissolve away the latent images 32*a* to form the ejection ports 32. The soluble pattern 103 was then dissolved away to form the liquid passages, such as the liquid feed chamber 3 and the pressure chambers 4, and the latent images 105*a* of the islands 6 in the photosensitive resin layer 105 were developed.

A liquid feed member 3*b* (see FIG. 1) was joined to the vibrating unit including the liquid passage structure and the piezoelectric elements 11 thus formed, and signal lines and a common line for driving the piezoelectric elements 11, i.e., liquid ejection pressure-generating elements, were electrically connected to the vibrating unit. A liquid ejection head was thereby completed.

With respect to the liquid ejection head thus fabricated, as in the liquid ejection head in Example 1 or 2, it was possible to perform printing stably, and high-quality printed matter was obtained.

The liquid ejection heads of the present invention thus fabricated are effective as full-line type liquid ejection heads which are capable of recording over the breadth of recording sheets, and are also effective as color recording heads which are integrally formed or in which a plurality of liquid ejection heads are combined. The liquid ejection heads of the present invention are also applicable to solid ink which becomes liquid at a temperature higher than a given temperature.

A second embodiment of the present invention will be described below with reference to FIG. 5 to FIGS. 15A and 15B.

Figure 5:
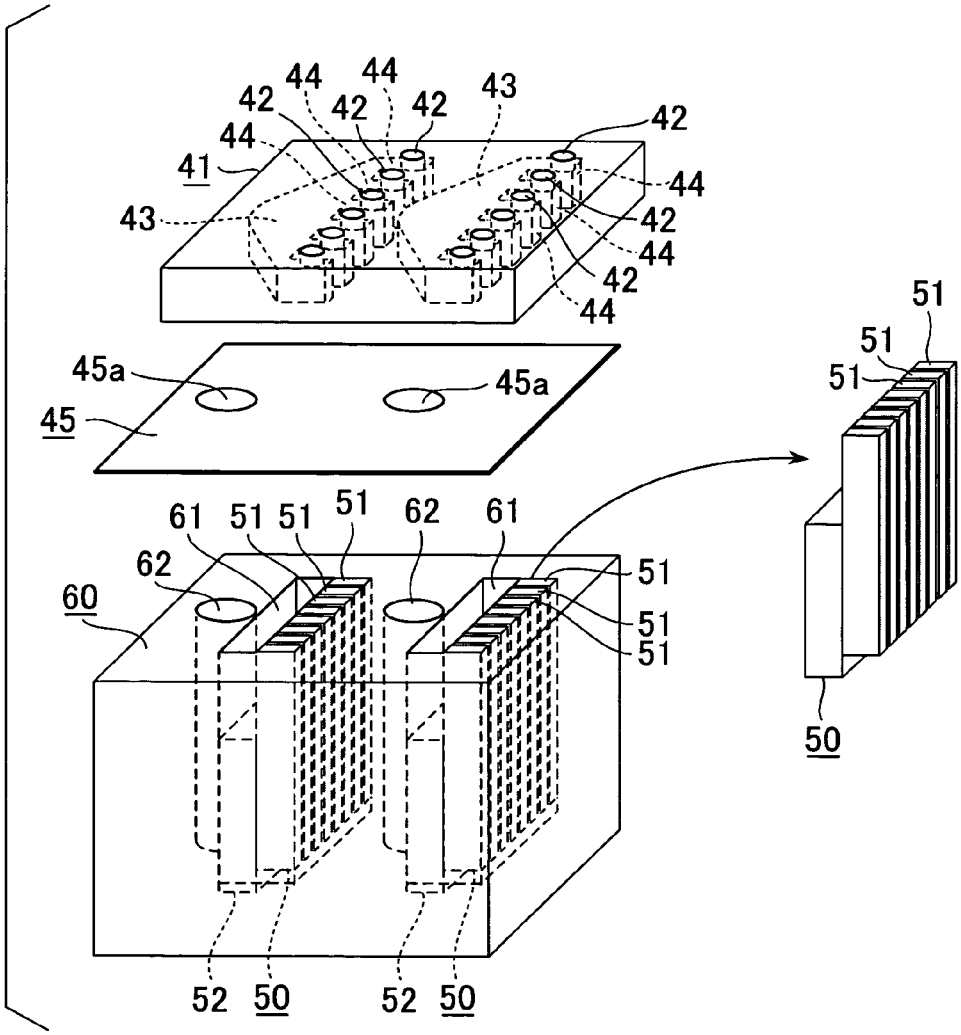
FIG. 5 is a perspective assembly view of a liquid ejection head in a second embodiment of the present invention.
Figure 6A:
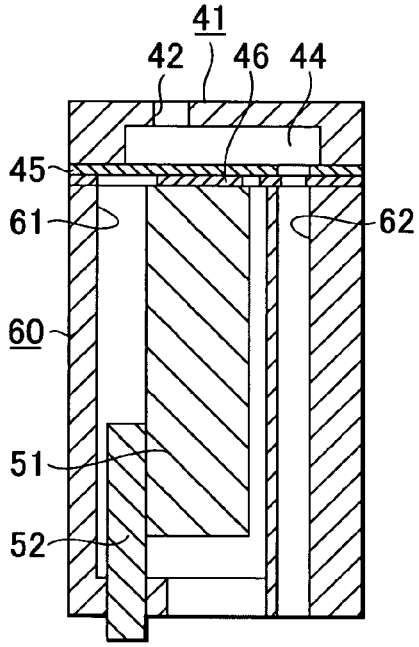
FIGS. 6A and 6B are sectional views cut along orthogonal longitudinal planes, showing the liquid ejection head shown in FIG. 5.
Figure 6B:
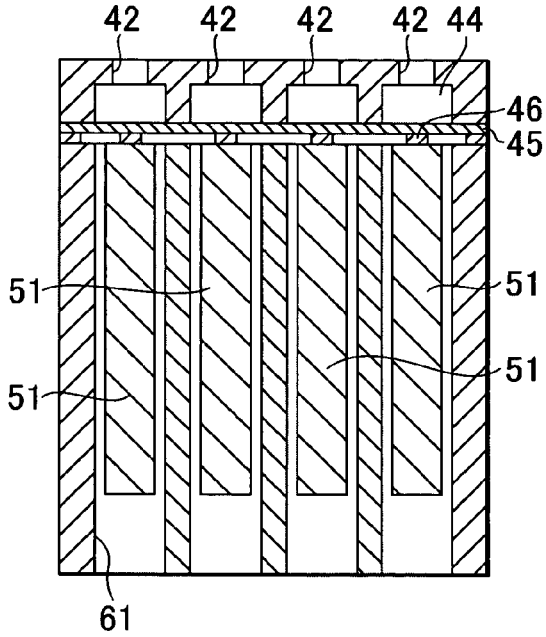

FIG. 5 is a perspective assembly view of a liquid ejection head in the second embodiment. In FIG. 5, an upper region including a liquid passage structure and a lower region including piezoelectric elements are separately shown to facilitate understanding of the structure of the head immediately before finishing the fabrication. FIGS. 6A and 6B are a longitudinal sectional view and a sectional view in the width direction, respectively, showing the liquid ejection head shown in FIG. 5.

A resin coating layer 41 which corresponds to the liquid passage structure includes two arrays of nozzles, each array including a plurality of ejection ports (nozzles) 42. As will be described below, liquid feed chambers 43, pressure chambers 44, etc., are formed by the step of dissolving away a resin pattern formed by patterning of a soluble resin.

A diaphragm 45 and islands 46 which correspond to isolated pressure-transmitting portions are disposed under the resin coating layer 41. Two openings 45*a* of the diaphragm 45 communicate with the two liquid feed chambers 43. One surface of the diaphragm 45 faces ejection ports 42 with pressure chambers 44 therebetween, and the other surface of the diaphragm 45 abuts on the ends of piezoelectric elements 51 of vibrator units 50 with the islands 46 therebetween. Each island 46 transmits elongation and contraction of the corresponding piezoelectric element 51 to a liquid in the corresponding pressure chamber 44.

The two vibrator units 50 are supported in a head housing 60. The head housing 60 is provided with receiving sections 61 for receiving the respective vibrator units 50 and liquid feed openings 62 which communicate with the openings 45*a* of the diaphragm 45.

In each vibrator unit 50, liquid ejection energy for ejecting liquid droplets, such as a recording liquid, is generated by the piezoelectric elements 51 which are arranged in a comb shape, and the energy is applied to the liquid in the pressure chambers 44 through the diaphragm 45 to perform recording, etc. That is, when the piezoelectric elements 51 are used as the liquid ejection energy-generating elements, ejection energy is generated by the mechanical vibration of the elements. Each vibrator unit 50 includes a supporting member 52 for supporting the individual piezoelectric elements 51, and a controller for driving the individual piezoelectric elements 51.

Figure 7A:
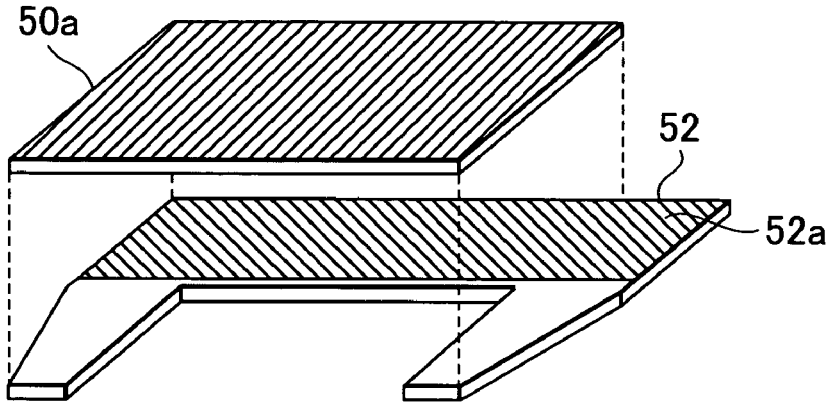
FIGS. 7A and 7B are perspective views showing a fabrication process for a vibrator unit.
Figure 7B:
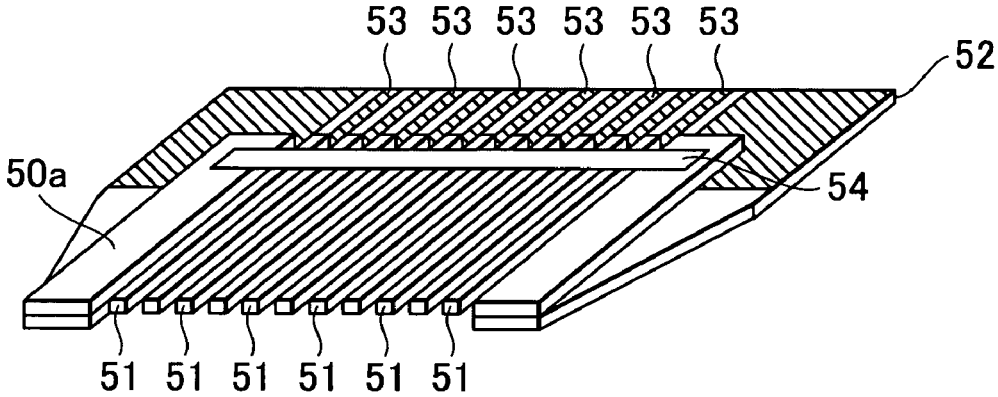

FIGS. 7A and 7B show a fabrication process for each vibrator unit 50. In order to fabricate the vibrator unit 50, a piezoelectric member 50*a* is cut from one end toward the other end according to the array pitch of the pressure chambers 44 to form a plurality of piezoelectric elements 51. In the cutting step, by setting the cutting depth of a dicing saw or the like so as to penetrate through a thin-film electrode 52*a* disposed on a support 52, it is possible to simultaneously form leads 53 for supplying driving signals. A common electrode 54 is also formed on the other surfaces of the piezoelectric elements 51 by fixing a conductive sheet with a conductive adhesive. When driving signals are applied to the leads 53 and the common electrode 54 from a controller, the piezoelectric elements 51 are elongated or contracted in the longitudinal direction.

The individual vibrator units 50 are placed in the head housing 60 so that the ends of the piezoelectric elements 51 are substantially flush with the outer wall surface. The resin coating layer 41 which is the liquid passage structure, etc., is disposed on that plane.

FIGS. 8A and 8B to FIGS. 15A and 15B show the fabrication process for the liquid passage structure. As shown in FIGS. 8A and 8B and FIGS. 9A and 9B, the spaces in the receiving sections 61, the liquid feed openings 62, etc., in the head housing 60 are filled with soluble resins 71 and 72. However, the resin 71 which fills the spaces between the piezoelectric elements 51 arranged in a comb shape and the receiving sections 61 may be insoluble when it is not dissolved away in the final stage as will be described below.

Furthermore, a surface 60*a* on which the resin coating layer 41, etc., is to be disposed is smoothened by polishing. By forming such a smooth surface, it becomes possible to form a resin layer thereon at any thickness below about 50 μm with high accuracy by coating means, such as spin coating or roll coating. One of the other advantages is that it becomes possible to apply a material thereon that cannot be formed into a dry film easily (material with poor coatability).

When a resin layer is disposed on the surface 60*a* to form the liquid passage structure, the piezoelectric elements 51, the islands 46, the pressure chambers 44, and the ejection ports 42 must be aligned accurately with each other. In the patterning step described below, alignment is preferably performed based on alignment marks, i.e., alignment means, provided on the piezoelectric elements 51 or the vibrator units 50, which may be observed through the resin.

Figure 10A:
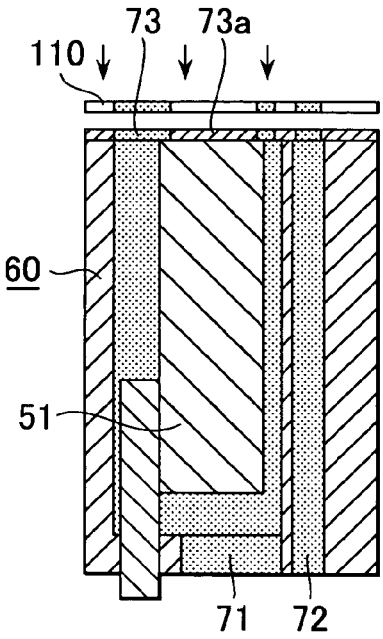
FIGS. 10A and 10B are sectional views of piezoelectric elements cut along orthogonal longitudinal planes of a liquid ejection head, and show a second step for forming the upper region of the liquid ejection head according to Example 4.
Figure 10B:
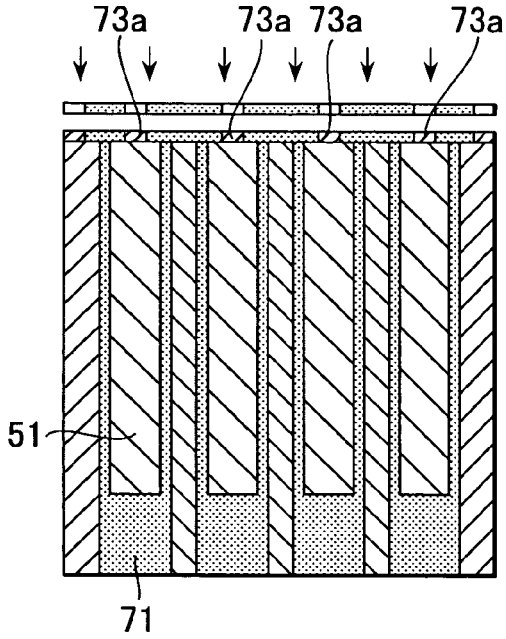

Next, as shown in FIGS. 10A and 10B, a photosensitive resin layer 73 is deposited on the surface 60*a* by spin coating or roll coating in order to form the islands 46 on the ends of the individual piezoelectric elements 51. Exposure is performed using a mask 110 to form latent images 73*a* of the isolated islands 46.

Figure 11A:
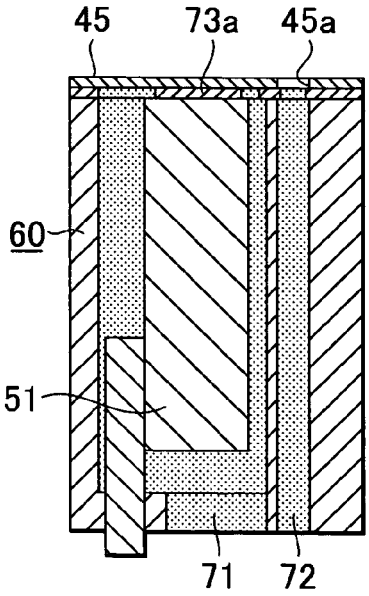
FIGS. 11A and 11B are sectional views of piezoelectric elements cut along orthogonal longitudinal planes of a liquid ejection head, and show a third step for forming the upper region of the liquid ejection head according to Example 4.
Figure 11B:
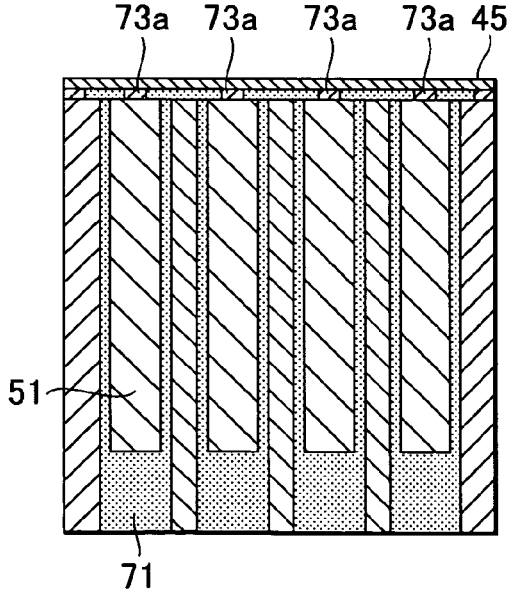

As shown in FIGS. 11A and 11B, a resin sheet having openings corresponding to the liquid feed openings 62 is attached to the photosensitive resin layer 73 provided with the latent images 73*a* to form a diaphragm 45 having openings 45*a*

The resin used for the diaphragm 45, which is a structural material for the liquid ejection head, must have high mechanical strength, heat resistance, adhesion to the substrate, resistance to liquid, such as ink, the ability not to modify such liquid, and other characteristics.

Figure 12A:
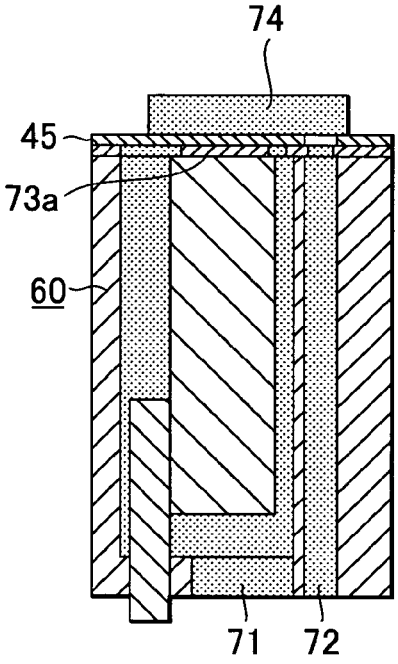
FIGS. 12A and 12B are sectional views of piezoelectric elements cut along orthogonal longitudinal planes of a liquid ejection head, and show a fourth step for forming the upper region of the liquid ejection head according to Example 4.
Figure 12B:
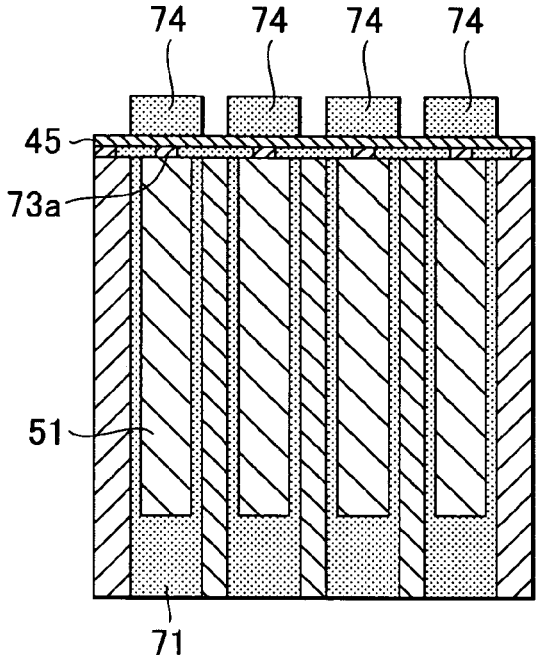

As shown in FIGS. 12A and 12B, a soluble resin is further deposited on the diaphragm 45 by spin coating or roll coating, followed by patterning to form a pattern 74 for the liquid passages, such as the liquid feed chambers 43 and the pressure chambers 44.

Figure 13A:
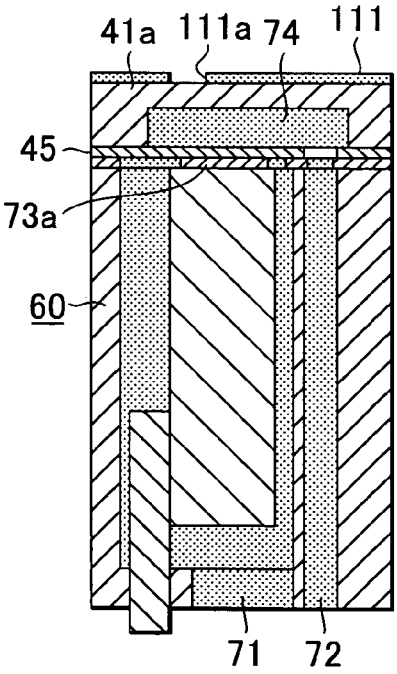
FIGS. 13A and 13B are sectional views of piezoelectric elements cut along orthogonal longitudinal planes of a liquid ejection head, and show a fifth step for forming the upper region of the liquid ejection head according to Example 4.
Figure 13B:
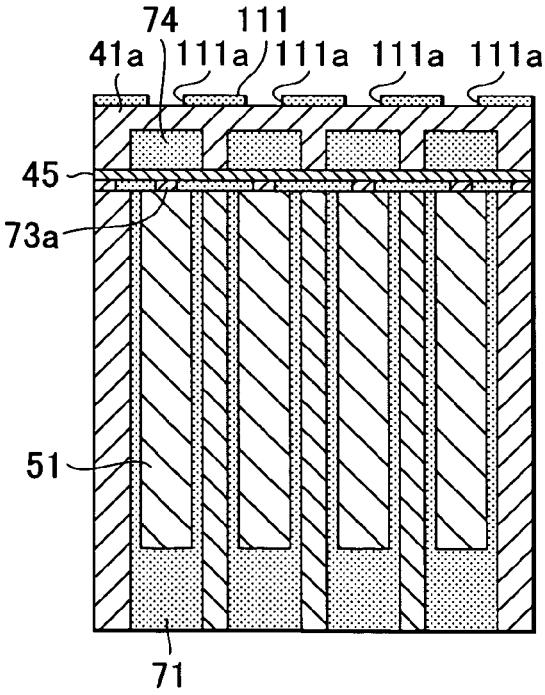

Next, as shown in FIGS. 13A and 13B, a resin layer 41*a* for forming the resin coating layer 41 is formed. The resin layer 41*a*, which is also a structural material for the liquid ejection head, must have high mechanical strength, heat resistance, adhesion to the substrate, resistance to liquid, such as ink, the ability not to modify such liquid, and other characteristics.

As the resin layer 41*a*, a resin which is polymerized and hardened by the application of light or heat energy and which strongly bonds to the base is preferably used.

Figure 14A:
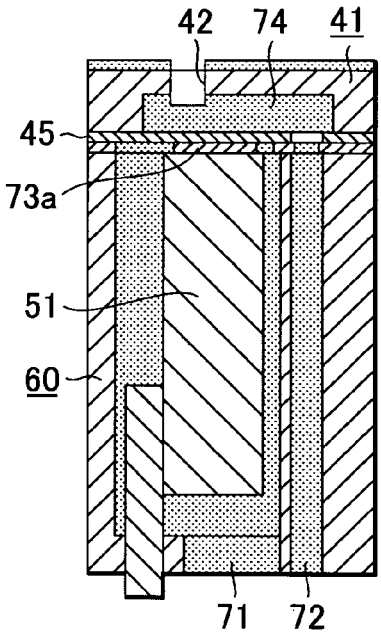
FIGS. 14A and 14B are sectional views of piezoelectric elements cut along orthogonal longitudinal planes of a liquid ejection head, and show a sixth step for forming the upper region of the liquid ejection head according to Example 4.
Figure 14B:
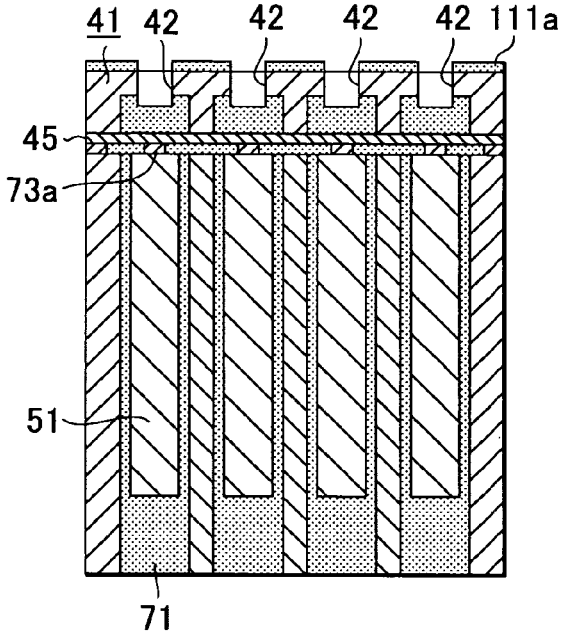

The resin layer 41*a* is then subjected to patterning. That is, a resist layer 111 for forming the ejection ports 42 is provided on the resin layer 41*a*, and openings 111*a* are formed. If the resin layer 41*a* is photosensitive, the ejection ports 42 are formed by patterning using photolithography. If a hardened resin layer is used, processing by an excimer laser or oxygen plasma etching may be used to form the ejection ports 42 as shown in FIGS. 14A and 14B.

Next, the resist layer 111, the resin 72 and the pattern 74 for the liquid passages are dissolved away with a solvent. The resin 71 filled in the spaces between the piezoelectric elements 51 and in the receiving sections 61 of the head housing 60, and the photosensitive resin layer 73 other than the latent images 73*a* which constitute the islands 46 are also dissolved away.

A liquid-feeding member is bonded onto the resin coating layer 41 provided with the pressure chambers 44, etc., thus fabricated. Electrical connection is performed to drive the piezoelectric elements 51. A liquid ejection head is thereby completed.

EXAMPLE 4

A liquid ejection head was fabricated according to a specific example of a method in the second embodiment, as shown in FIGS. 7A and 7B to FIGS. 15A and 15B.

First, vibrator units 50 were fabricated as ejection energy-generating elements. As shown in FIGS. 7A and 7B, in order to fabricate each vibrator unit 50, a part of a laminated piezoelectric vibrating plate 50*a* in which piezoelectric layers and electrode layers, 20 layers in total, were alternately laminated so that driving was enabled at a low voltage of about 24 V, was fixed on a support 52 provided with a thin-film electrode 52*a* on the surface with a conductive adhesive KE3492 (manufactured by Shin-Etsu Chemical Co., Ltd.). The free end of the laminated piezoelectric vibrating plate 50*a* facing the cut-out section of the support 52 was cut from one end toward the other end according to the array pitch of pressure chambers 44 to form a plurality of piezoelectric elements 51 so as to be arranged in a comb shape. In the cutting step, by setting the cutting depth of a dicing saw or the like so as to penetrate through the thin-film electrode 52*a*, it is possible to simultaneously form leads 53 for supplying driving signals. In this example, the cutting width was set at 90 μm, and dicing was performed at a cutting depth of 550 μm against the laminated piezoelectric vibrating plate 50*a* with a thickness of 500 μm. A common electrode 54 was formed on the other surfaces of the piezoelectric elements 51 by fixing a conductive sheet with a conductive adhesive. Consequently, when driving signals are applied to the leads 53 and the common electrode 54, the piezoelectric elements 51 are elongated or contracted in the longitudinal direction.

Figure 8A:
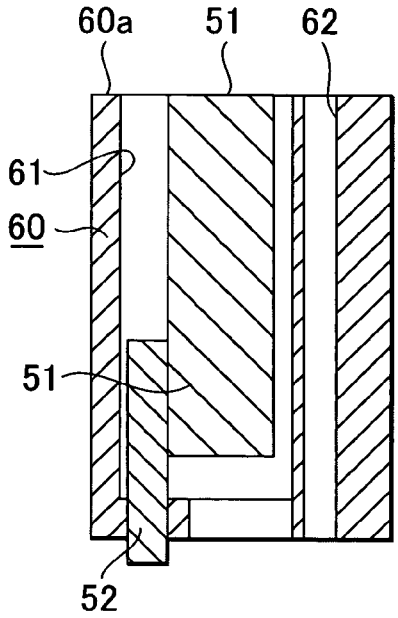
FIGS. 8A and 8B are sectional views of piezoelectric elements cut along orthogonal longitudinal planes of a liquid ejection head.
Figure 8B:
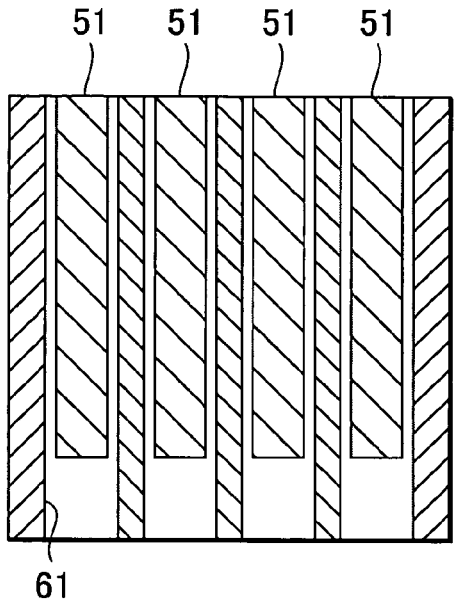

The vibrator unit 50 was placed in the receiving section 61 of the head housing 60 so that the ends of the piezoelectric elements 51 were substantially flush with the outer wall surface (see FIGS. 5, 8A and 8B).

A liquid passage structure was then fabricated, as described below.

Figure 9A:
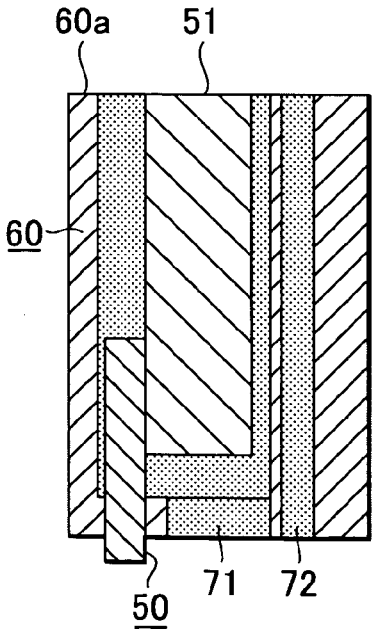
FIGS. 9A and 9B are sectional views of piezoelectric elements cut along orthogonal longitudinal planes of a liquid ejection head, and show a first step for forming the upper region of a liquid ejection head according to Example 4.
Figure 9B:
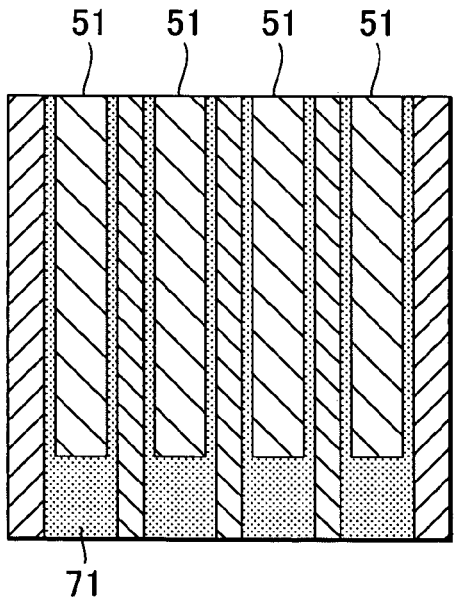

First, as shown in FIGS. 9A and 9B, the spaces between the piezoelectric elements 51, the receiving sections 61, and the liquid feed opening 62, etc., were filled with soluble resins 71 and 72. As the resins 71 and 72, PMER A-900 (manufactured by Tokyo Ohka Kogyo Co., Ltd.) was used. Furthermore, a surface 60*a* on which the liquid passage structure was to be formed was smoothened by polishing.

Next, islands 46 were formed on the ends of the individual piezoelectric elements 51. In order to form the islands 46, as shown in FIGS. 10A and 10B, a photosensitive resin layer 73 was formed by spin coating, and exposure was performed using a mask 110. Latent images 73*a* of the isolated islands 46 were thereby formed.

Next, a resin sheet having openings corresponding to the liquid feed openings 62 was attached to the photosensitive resin layer 73 provided with the latent images 73*a*, and a diaphragm 45 having openings 45*a* was thereby formed as shown in FIGS. 11A and 11B. In this example, an alicyclic epoxy resin EHPE-3150 (manufactured by Daicel Chemical Industries, Ltd.) was used and a mixed catalyst of 4,4'-di-tert-butyldiphenyl iodonium hexafluoroantimonate/copper triflate was used as a thermosetting cationic photopolymerization catalyst. A Canon mask aligner MPA-600 was used for the exposure operation.

Alternatively, a polyphenyl sulfide film may be used as the resin sheet and an opening may be formed by a mechanical process. Since the size of the liquid feed openings is relatively large, accuracy is not particularly required when the resin sheet is attached.

Furthermore, as shown in FIGS. 12A and 12B, PMER A-900 (manufactured by Tokyo Ohka Kogyo Co., Ltd.) as a soluble resin was deposited on the diaphragm 45 by spin coating, and patterning was performed with a Canon mask aligner MPA-600, followed by development. A pattern 74 for the liquid passages was thereby formed.

The PMER A-900 resin, which is a novolac resist and has high resolution and stable patterning characteristics, has poor coatability and cannot be formed into a dry film easily. In this embodiment, since the surface of the diaphragm 45 was planar, it was possible to form a novolac resist layer by spin coating with a predetermined thickness accurately.

Next, as shown in FIGS. 13A and 13B, a resin layer 41*a* for forming the resin coating layer 41 was deposited on the pattern 74 by spin coating.

Since the resin layer 41*a* is a structural material for the ink jet head, it must have high mechanical strength, ability to adhere to the substrate, resistance to ink, and other characteristics. Most preferably, an epoxy resin which is cationically polymerized and cured by a thermal reaction or photoreaction is used as the resin layer 41*a*. In this example, an alicyclic epoxy resin EHPE-3150 (manufactured by Daicel Chemical Industries, Ltd.) was used as an epoxy resin and a mixed catalyst of 4,4'-di-tert-butyldiphenyl iodonium hexafluoroantimonate/copper triflate was used as a thermosetting cationic polymerization catalyst.

As shown in FIGS. 14A and 14B, ejection ports 42 were formed on the resin layer 41*a*. In this example, the ejection ports 42 were formed by oxygen plasma etching.

A silicon-containing positive resist FH-SP (manufactured by Fuji Hunt) 111 was applied on the resin layer 41*a*, and patterning was performed to form a pattern of resist layer 111 and ejection port regions (FIGS. 13A and 13B). The ejection port regions were then etched by oxygen plasma etching. The resist FH-SP functioned as an oxygen-plasma resistant film, and the etching was stopped at a predetermined position in the pattern 74 for the liquid passages. The surface of the diaphragm 45 was prevented from being damaged.

Although the ejection ports 42 were formed by oxygen plasma etching in this example, the ejection ports 42 may alternatively be formed by ablation in which irradiation is performed by an excimer laser using a mask.

Figure 15A:
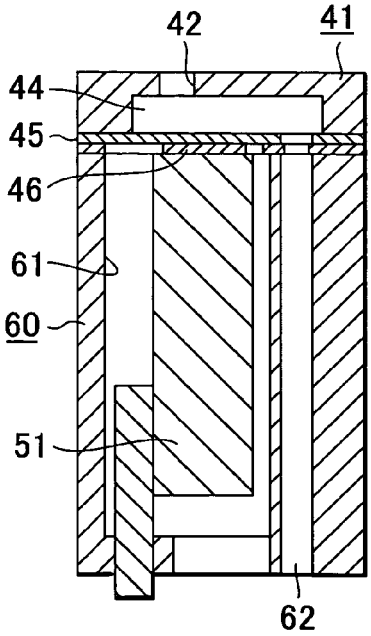
FIGS. 15A and 15B are sectional views of piezoelectric elements cut along orthogonal longitudinal planes of a liquid ejection head, and show a seventh step for forming the upper region of the liquid ejection head according to Example 4.
Figure 15B:
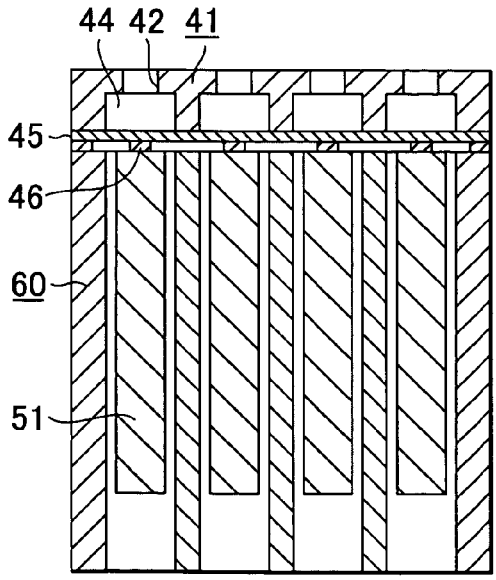

Next, as shown in FIGS. 15A and 15B, the resin 72 filled in the liquid feed opening 62, etc., the pattern 74 for the liquid passages, and the resist layer 111 composed of FH-SP were washed away. At this stage, the resin 71 filled in the spaces between the piezoelectric elements 51 and the receiving section 61 of the head housing 60 were dissolved away, and the uncured portions of the photosensitive resin layer 73 other than the latent images 73*a* were also dissolved away to form the isolated islands 46. In this step, it is desirable to simultaneously remove the resins 71 and 72, the pattern 74 for the liquid passage, the resist layer 111, and the uncured portions of the photosensitive resin layer 73 other than the latent images 73*a*, for ease of fabrication.

A liquid feed member was then attached and electrical connection for signal input was performed. A liquid ejection head was thereby completed.

The liquid ejection head was mounted on a recording apparatus, and printing was performed using an ink composed of pure water/diethylene glycol/isopropyl alcohol/lithium acetate/black dye Food Black 2 (79.4/15/3/0.1/2.5). As a result, it was possible to perform printing stably, and high-quality printed matter was obtained.

EXAMPLE 5

Another specific example of a method for making the liquid ejection head in the second embodiment will be described below.

Figure 16A:
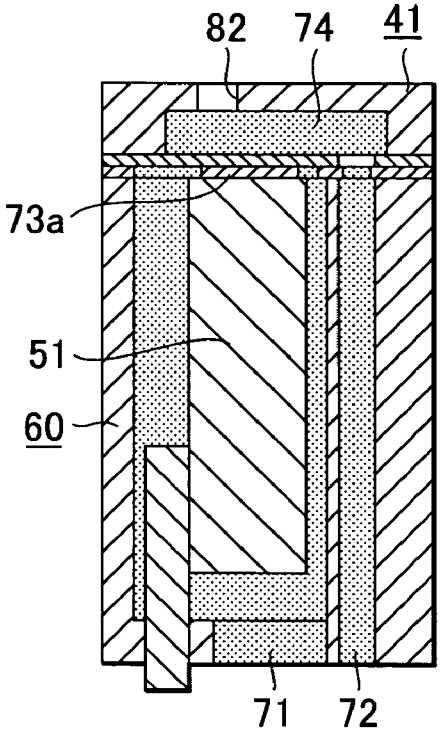
FIGS. 16A and 16B are sectional views of piezoelectric elements cut along orthogonal longitudinal planes of a liquid ejection head, and show a step for forming ejection ports by photolithography according to Example 5.
Figure 16B:
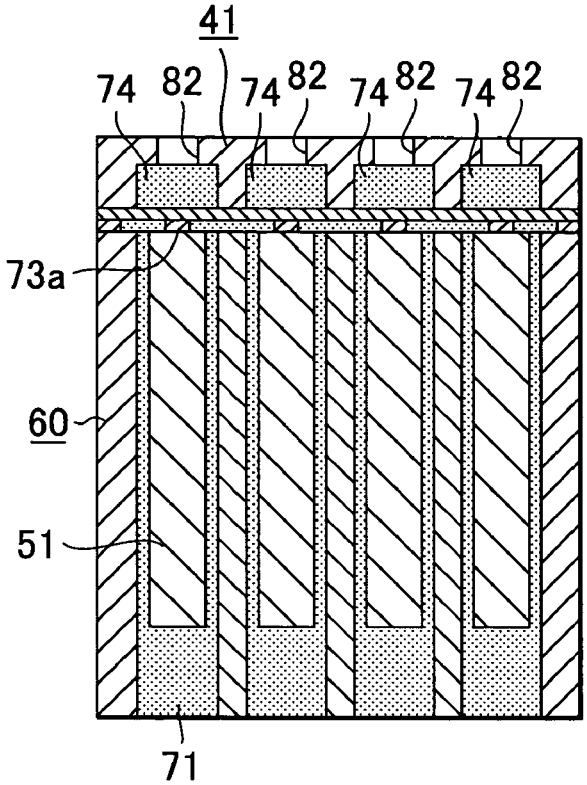

As shown in FIGS. 16A and 16B, as in Example 4, a pattern 74 for the liquid passages was formed using PMER A-900 as a soluble resin, and a resin coating layer 41 was formed thereon. The same composition as that in Example 4 was used for the resin coating layer 41. Since the mixed catalyst of 4,4'-di-tert-butyldiphenyl iodonium hexafluoroantimonate/copper triflate is photosensitive, ejection ports 82 were formed by photolithography. That is, after the resin coating layer 41 was formed, exposure was performed with a Canon mask aligner PLA 520 (cold mirror 250) using a mask, followed by development to form the ejection ports 82.

Subsequently, the resin 72 in the liquid feed openings 62, the pattern 74 for the liquid passages, etc., were removed as in Example 4, and a liquid ejection head was thereby completed.

A liquid feed member was then attached and electrical connection for signal input was performed. It was possible to perform printing satisfactorily.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for making a liquid ejection head comprising a plurality of ejection ports, a liquid passage having a plurality of pressure chambers communicating with the plurality of ejection ports, and a plurality of piezoelectric elements corresponding to the plurality of pressure chambers with isolated pressure-transmitting portions between the corresponding piezoelectric elements and pressure chambers, respectively, the plurality of piezoelectric elements being arranged in a comb shape, the method comprising the steps of:

(a) filling the spaces between the piezoelectric elements with a filler;

(b) forming a pressure-transmitting layer for forming the isolated pressure-transmitting portions on a planar surface including ends of the plurality of piezoelectric elements;

(c) placing a diaphragm on the pressure-transmitting layer and forming a pattern for the liquid passage on the diaphragm;

(d) forming a coating layer on the pattern for the liquid passage;

(e) removing the pattern for the liquid passage to form the plurality of pressure chambers; and (f) removing the pressure-transmitting layer except for the portions corresponding to the plurality of pressure chambers, to form the isolated pressure-transmitting portions.

2. The method for making the liquid ejection head according to claim 1, further comprising step (g) of removing the filler from the spaces between the piezoelectric elements.

3. The method for making the liquid ejection head according to claim 2, wherein the steps (e), (f), and (g) are performed simultaneously.

4. The method for making the liquid ejection head according to claim 2, wherein a liquid feed opening for feeding a liquid to the liquid passage is also filled with another filler in step (a), and the filler is also removed from the liquid feed opening in step (g).

5. The method for making the liquid ejection head according to claim 1, wherein the planar surface including the ends of the plurality of piezoelectric elements is smoothened by polishing before step (b).

6. The method for making the liquid ejection head according to claim 1, wherein the pattern for the liquid passage is light-transmissive, and in step (c), the pattern for the liquid passage is positioned using alignment means for the plurality of piezoelectric elements detectable through the pattern for the liquid passage.

7. The method for making the liquid ejection head according to claim 1, further comprising a step of forming the ejection ports by laser ablation.

8. The method for making the liquid ejection head according to claim 1, further comprising a step of forming the ejection ports by oxygen plasma etching.

9. The method for making the liquid ejection head according to claim 1, further comprising a step of forming the ejection ports by photolithography.

10. The method for making the liquid ejection head according to claim 1, further comprising a step of forming the plurality of piezoelectric elements by cutting a piezoelectric member according to the array pitch of the pressure chambers so that the piezoelectric elements are arranged in a comb shape.

11. A method for making a liquid ejection head comprising a plurality of ejection ports, a liquid passage having a plurality of pressure chambers communicating with the plurality of ejection ports, and a plurality of piezoelectric elements arranged in parallel so as to correspond to the plurality of pressure chambers with isolated pressure-transmitting portions between the corresponding piezoelectric elements and pressure chambers, respectively, the method comprising the steps of:

(a) filling the spaces between the piezoelectric elements with a filler;

(b) forming a pressure-transmitting layer for forming the isolated pressure-transmitting portions on a planar surface including ends of the plurality of piezoelectric elements;

(c) placing a diaphragm on the pressure-transmitting layer and forming a pattern for the liquid passage on the diaphragm;

(d) forming a coating layer on the pattern for the liquid passage;

(e) removing the pattern for the liquid passage to form the plurality of pressure chambers; and (f) removing the pressure-transmitting layer except for the portions corresponding to the plurality of pressure chambers, to form the isolated pressure-transmitting portions.

* * * * *